United States Patent [19]

Taniguchi et al.

[11] Patent Number: 4,565,320

[45] Date of Patent: Jan. 21, 1986

[54] UNIT INJECTOR OF INTERNAL COMBUSTION ENGINE

[75] Inventors: Hiroyuki Taniguchi, Otsu; Hiroaki Tsukahara, Kawanishi, both of Japan

[73] Assignee: Yanmar Diesel Engine Co. Ltd., Osaka, Japan

[21] Appl. No.: 357,879

[22] Filed: Mar. 15, 1982

[51] Int. Cl.[4] ..... F02M 47/02

[52] U.S. Cl. ..... 239/90; 239/88

[58] Field of Search ..... 239/88–93

[56] References Cited

U.S. PATENT DOCUMENTS

| | | | |
|---|---|---|---|
| 2,144,861 | 1/1939 | Truxell, Jr. | 239/88 |
| 2,378,165 | 6/1945 | Waeber | 239/93 |
| 2,408,288 | 9/1946 | Bremser | 239/88 |
| 2,571,501 | 10/1951 | Truxell, Jr. | 239/90 |
| 2,576,451 | 11/1951 | Dickson et al. | 239/90 |
| 2,740,668 | 4/1956 | Paluch et al. | 239/91 |
| 2,799,263 | 7/1957 | French | 239/88 |
| 2,912,168 | 11/1959 | L'Orange | 239/88 |
| 2,985,378 | 5/1961 | Falberg | 239/91 |
| 3,635,403 | 1/1972 | Hofken et al. | 239/90 |

FOREIGN PATENT DOCUMENTS 542717 6/1957 Canada .

*Primary Examiner*—Andres Kashnikow
*Assistant Examiner*—James R. Moon, Jr.
*Attorney, Agent, or Firm*—Henry Sternberg; Bert J. Lewen

[57] ABSTRACT

A unit fuel injector for internal combustion engines having a fuel injecting pump portion and a fuel injection valve portion which are assembled as a unit in a single injector body (6). The injector body (6) has an upper section into which a check valve (9), barrel (5), plunger (3), and so forth are inserted from the upper side of the injector body. The check valve, barrel, plunger and so forth are secured by means of a barrel holder (7) screwed into the upper section of the injector body. Also a nozzle spring (13), nozzle body (19), nozzle valve (18) and so forth are assembled and placed within from the lower side of the injector body. The nozzle spring, nozzle body, nozzle valve and so forth are fixed by a nozzle nut (20) screwed to the lower section. This arrangement permits the diameter of the unit fuel injector to be reduced to facilitate the mounting in the limited space on a cylinder head of the engine.

13 Claims, 21 Drawing Figures

UNIT INJECTOR OF INTERNAL COMBUSTION ENGINE

The present invention relates to a fuel injector for diesel engines and, more particularly, to a unit injector in which an injection pump and an injection valve are assembled as a unit.

In the conventional fuel injection system, a fuel injection pump and a fuel injection valve are constructed as separate units and are connected to each other by a high-pressure tube. Recently, however, it is proposed to unite the fuel injection pump and the fuel injection valve into one body. This type of fuel injection system is generally referred to as a "unit injector". The known unit injectors, however, are generally large in size and difficult to disassemble. In fact, it is quite difficult to mount the unit injector on small-sized diesel engines having output power of less than 50 hp. In assembling of these conventional unit injectors, various parts such as barrel, plunger, check valve, nozzle spring, nozzle valve, nozzle body and so forth are inserted into the injector body from the lower side thereof, and are finally fastened by means of a case nut. Since the assembling is made from one side of the injector body, the assembling error is accumulated to cause a large error in the finally assembled state. The unit injector as a whole has a large size in the assembled state, and therefore it is difficult to mount such a large unit injector in the limited space on the cylinder head. In addition, it takes an impractically long time to disassemble this unit injector for the purpose of repair or inspection.

Accordingly, an object of the invention is to provide a unit injector which can eliminate the problems of the prior art explained hereinabove.

To this end, the invention provides a unit injector in which an injector body has two sections: namely an injection pump section for receiving the injection pump portion from the upper side of the injector body and an injection valve section to which the injection valve portion is fitted from the lower side of the injector body by means of a nozzle nut. The injection pump portion and the injection valve portion of the unit injector communicate with each other through a check valve interposed therebetween. In consequence, the unit injector as a whole can have a slim shape which in turn facilitates the mounting of the unit injector in the limited space at the central portion of the cylinder head on which various parts such as intake valves, exhaust valves and so forth are mounted in a concentrated manner.

More specifically, according to one aspect of the invention, there is provided a unit fuel injector for internal combustion engines having a single injector body containing a nozzle spring, nozzle body, nozzle valve and so forth assembled and placed within from the lower side of said injector body, said nozzle spring, nozzle body, nozzle valve and so forth are secured by means of a nozzle nut screwed to said injector body from the lower side thereof, said injector body further contains a check valve, a barrel, and a plunger and so forth inserted thereinto from the upper side of the injector body, said check valve, barrel and plunger being secured by means of a barrel holder screwed to said injector body from the upper side.

According to another aspect of the invention, there is provided a unit fuel injector for internal combustion engines wherein a body of the injector has a fuel well and a nozzle spring chamber formed therein, said fuel well and said nozzle spring chamber being separated from each other by a check valve guide but communicate with each other through a fuel passage formed in said check valve guide.

According to still another aspect of the invention, there is provided a unit fuel injector for internal combustion engines wherein a valve port formed in a check valve seat interposed between a fuel injection pump portion and a fuel injection valve portion of said unit injector has a diameter smaller than the diameter of a plunger.

According to a further aspect of the invention, there is provided a unit fuel injector for internal combustion engines as firstly defined hereinabove wherein said injector body has an upper section for receiving said plunger and said barrel and a nozzle spring chamber formed in the lower portion thereof, said upper section and said nozzle spring chamber being separated from each other by a partition wall serving as a check valve guide, said nozzle spring chamber being closed at its lower end by a valve stop spacer.

According to a still further aspect of the invention, there is provided a unit fuel injector for internal combustion engines as firstly defined hereinabove characterized in that the upper surface of a barrel holder for fixing said barrel to said injector body serves also as a spring retainer for retaining the end of said plunger spring adjacent to said barrel.

According to a still further aspect of the invention, there is provided a unit fuel injector for internal combustion engines as firstly defined hereinabove, wherein said barrel is fitted in an upper bore of said injector body and fastened and fixed at its outer side by a barrel holder screwed into said upper bore, said barrel holder being provided with a retainer for retaining one end of said plunger spring and a groove for engagement by a tool for screwing up said barrel holder.

According to a still further aspect of the invention, there is provided a unit fuel injector for internal combustion engines as firstly defined hereinabove, characterized by comprising a control lever for controlling the rate of injection of fuel, said control lever being connected at its one end to said plunger and at its other end to a link of a governor, so that said plunger is rotated by said link of said governor through said control lever.

According to a still further aspect of the invention, there is provided a unit fuel injector for internal combustion engines as firstly defined hereinabove, wherein said plunger has an end projecting above a cylindrical tappet, and wherein a tappet plate is placed on the projected end of said plunger in such a manner as to rest on said cylindrical tappet.

According to a still further aspect of the invention, there is provided a unit fuel injector for internal combustion engines as firstly defined hereinabove, characterized by further comprising an arcuate spill deflector made from a resilient thin plate and disposed in the gap formed between a suction port formed in the plunger barrel and the inner surface of the body.

According to a still further aspect of the invention, there is provided a unit fuel injector for internal combustion engines as firstly defined hereinabove, characterized by further comprising an arcuate spill deflector fitted to the portion of the inner surface of the injector body opposite to a suction port formed in the barrel, said spill deflector being located by a spring pin provided on the outer periphery of said injector body.

According to a still further aspect of the invention, there is provided a unit fuel injector for internal combustion engines as firstly defined hereinabove, characterized in that an opening for permitting a control lever to rotate within a limited range is formed in a tappet, so that said tappet is operable from the outside of the unit injector to rotate relatively to said injector body, thereby to vary the range of rotation of said control lever to permit the adjustment of fuel injection rate.

According to a still further aspect of the invention, there is provided a unit fuel injector for internal combustion engines as firstly defined hereinabove, wherein a locating groove for indicating the position of the plunger is formed in the outer peripheral surface of a tappet adapted to slide along the inner periheral surface of said injector body.

According to a still further aspect of the invention, there is provided a unit fuel injector for internal combustion engines as firstly defined hereinabove, characterized by further comprising a control lever having a bifurcated end connected to the link of a governor while the other end being connected to said plunger, so that said control lever is moved up and down in accordance with the vertical reciprocating movement of said plunger.

According to a still further aspect of the invention, there is provided a unit fuel injector for internal combustion engines as firstly defined hereinabove, characterized by further comprising a limiting device for limiting the range of movement of a control lever for rotating said plunger to effect the adjustment of fuel injection rate, said limiting means being adjustable to permit the adjustment of fuel injection rate so that it is possible to equalize the fuel injection rates of all unit fuel injectors mounted on different cylinders of said engine.

According to a still further aspect of the invention, there is provided a unit fuel injector for internal combustion engines as firstly defined herein above, characterized in that said unit fuel injector is fixed to a cylinder head by means of a part of a valve arm supporting base mounted on said cylinder head.

By way of example only, certain illustrative embodiments of the invention will now be described with reference to the accompanying drawings in which.

Figure 1:
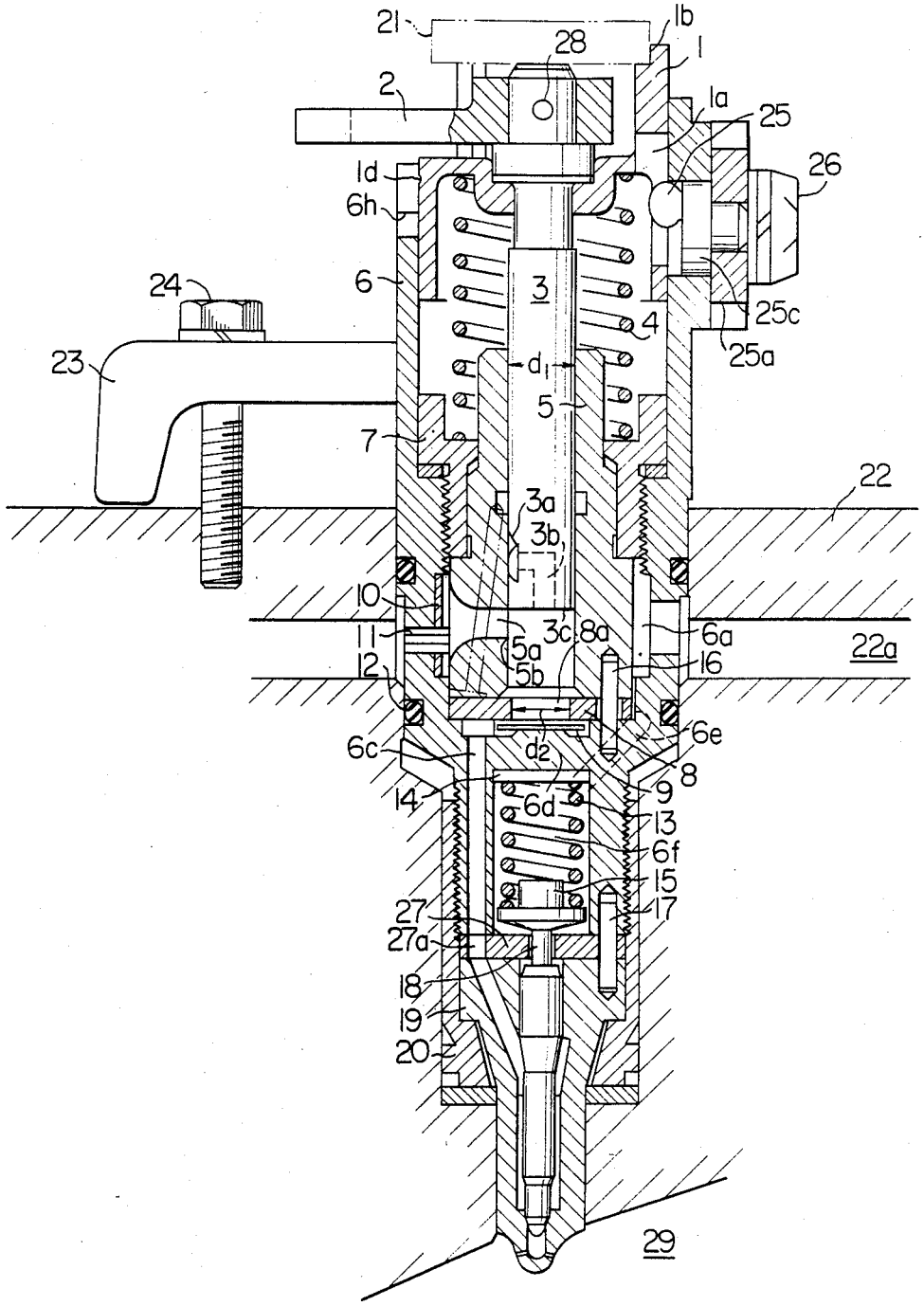
FIG. 1 is a vertical sectional view of a unit injector constructed in accordance with an embodiment of the invention.
Figure 2:
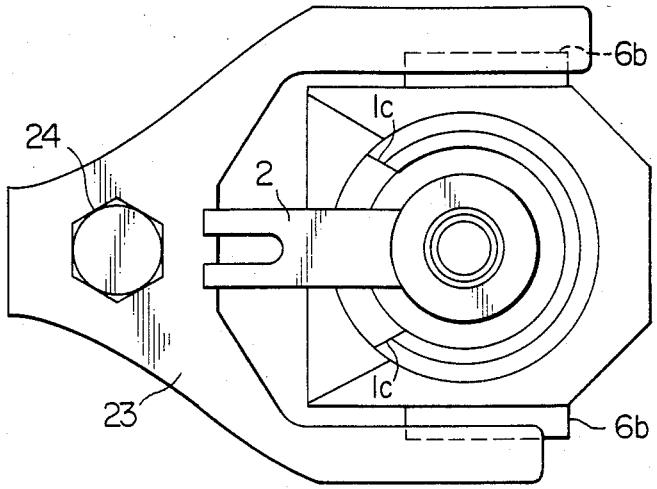
FIG. 2 is a plan view of the unit injector shown in FIG. 1.

Referring first to FIGS. 1 and 2 showing a first embodiment, the unit injector has a single injector body 6 which is provided on its outer surface with lugs **6*b* adapted to be engaged by a bifurcated fixing member 23 which is fastened to the cylinder head 22 by an elongated bolt 24. The unit injector of the invention is characterized in that some of the parts of the injector are inserted into the injector body from the upper side while the other parts are mounted in the injector body from the lower side thereof. More specifically, the injector body 6 is divided into an upper section and a lower section by a check valve guide 6*d* formed in the central portion of the injector body 6** integrally therewith.

Namely, a nozzle spring 13 and a nozzle spring seat 15 are inserted into the injector body 6 from the lower side of the injector body 6 and a valve stop spacer 27 is fitted to the lower side of the nozzle spring seat 15 to cover the latter from the lower side. A nozzle body 19 receiving a nozzle valve 18 is fitted to the injector body to underlie the valve stop spacer 27 and a nozzle nut 20 is screwed to the injector body 6.

On the other hand, from the upper side of the injector body 6, a check valve 9 and a check valve seat 8 are fitted into the injector body 6. Then, a spill deflector 10 is fixed by means of a spring pin 11 and, thereafter, a barrel 5 is placed and fixed by means of a barrel holder 7 screwed into the injector body 6. Then, a plunger 3 is inserted into the cylinder bore of the barrel 5, and a tappet 1 is fitted around the plunger 3 so as to rest on a plunger spring 4. The tappet 1 is provided in its outer peripheral surface with a groove **1*d*. The end of the plunger just passes the edge of a suction port 5*a* to commence the compression stroke when the groove 1*d* is brought into alignment with a line 6*h* formed in the cut end of the injector body 6**.

A control lever 2 is directly connected to the upper end portion of the plunger 3 projecting above the tappet 1 by means of a parallel pin 28. The control lever 2 is engaged by an arm of a governor device. As will be seen from FIG. 2, the tappet 1 has a horse-shoe-like upper end which has a sector-shaped opening defined by the cut edges **1*c*, 1*c*. The control lever extends through this arcuate opening so as to be able to rotate in one and the other directions. The arrangement is such that the injection rates of unit injectors of all cylinders are equalized by a later-mentioned adjusting device when the control levers 2 of all cylinders contact the edges 1*c*** of the associated tappets.

The horse-shoe-like portion of the tappet 1 is provided with a recess **1*b* in which fitted is a tappet plate 21. A rocker arm (not shown) operatively connected to a cam shaft depresses the upper surface of the tappet plate 21 thereby to move the plunger downwardly overcoming the force of the plunger spring 4. The plunger is returned upwardly by the force of the plunger spring 4** as it is relieved from the pressing force of the rocker arm.

The fuel to be injected is introduced into a fuel well 6*a* through a fuel passage 22*a* via a hole formed in the injector body. A spill deflector 10 is fixed by a spring pin 11 to the surface of the fuel well 6*a* opposing to the suction port 5*a*. Subsequently, the fuel is sucked through the suction port 5*a* as the plunger is retracted upward. In this case, the check valve 9 is attracted to make a close contact with the check valve seat 8 thereby to prevent the discharged fuel from being returned.

Referring to FIG. 1, a reference numeral 17 designates a parallel pin for locating the valve stop spacer 27 and the injector body 6, while 16 designates a parallel pin for locating the check valve seat 8 and the barrel 5. A reference numeral 12 denotes an "O" ring, while 14 designates a shim for adjusting the pressure of the nozzle spring 13.

The unit injector of this embodiment having a construction heretofore described operates in a manner explained below. The plunger 3 is moved downward as the rocker arm (not shown) depresses the tappet plate 21. Then, as the end of the plunger 3 comes out of alignment with the edge of the suction port 5*a*, the plunger 3 starts to pressurize the fuel. The pressurizing of the fuel is finished when an inclined notch 3*a* comes into communication with the suction port 5*a*. Namely, even though the plunger is lowered beyond this position, the fuel in the cylinder escapes through an oil passage 3*b* formed in the plunger, tapered notch 3*a* and the suction port 5*a*. The timing at which the tapered notch 3*a* is brought into communication with the suction port 5*a* is varied by rotating the plunger 3 by means of the control lever 2. Namely, by rotating the plunger 3, the time length or effective pressurizing stroke of the plunger is changed to vary the rate of injection of the fuel. The pressurized fuel is forced into the nozzle body 19 through the check valve 9, via the passage 6*c* and the valve stop spacer 27. As the fuel pressure in the nozzle body 19 reaches a predetermined opening pressure for the nozzle valve 18, the nozzle valve 18 is lifted overcoming the force of the nozzle spring 13 to permit the pressurized fuel to be injected into the combustion chamber 29.

The general construction and operation of the unit injector unit shown in FIGS. 1 and 2 have been described. A detailed description will be made hereinunder as to novel features of this unit injector over the conventional unit injector.

In the described embodiment, the nozzle spring, nozzle body, nozzle valve and so forth constituting the injection valve portion is assembled and positioned within from the lower side of the injection body and fastened by the nozzle nut, while the parts constituting the injection pump portion such as check valve, barrel, plunger, and so forth are inserted into the injector body from the upper side of the latter and fastened by means of the barrel nut. Thus, the high-pressure section and the low-pressure section are separated from each other by the check valve portion so that the leakage of fuel is remarkably decreased. In addition, since some parts are fitted into the injector body from the upper side while the other are from the lower side, it is possible to obtain a higher precision of assembling. For the same reason, it is possible to repair the injection pump portion and the injection valve portion independently of each other.

The assembling from two directions permits the size of the screw thread portion to be decreased, which in turn provides a slim shape of the unit injector as a whole thereby to facilitate the mounting of the unit injector in the limited space on the cylinder head.

In contrast therewith, in the asssembling of the conventional unit injector, at first the fuel pump is inserted into the injector body from the lower side followed by the insertion of the check valve guide. Then, the injection valve is inserted and fastened to the injector body by means of the nozzle nut. Therefore, the fuel leaking from the nozzle valve is returned from the nozzle spring chamber to the inner surface of the nozzle nut and then to the fuel well defined between the barrel and the injector body via the passage around the check valve guide. Since the passage for returning the leaking fuel is formed in the inner surface of the nozzle nut, the diameter of the nozzle nut is inevitably increased against the requirement for reduction of size of the unit injector.

This problem, however, can be overcome by the present invention as will be understood from the following description. Namely, according to the invention, the check valve guide 6*d* is formed at the center of the injector body 6 integrally therewith to separate the chamber for the injection pump and the chamber for the injection valve from each other. The fuel passage 6*e* for returning fuel is formed in the check valve guide 6*d*. The space in the nozzle spring chamber 6*f* and the fuel well 6*a* are communicated with each other through the returning fuel passage 6*e* and the gap formed between the inner peripheral surface of the injector body 6 and the outer peripheral surfaces of the check valve seat 8 and the barrel 5, thereby to permit the fuel to be returned to the fuel well 6*a*. Since the return fuel passage is formed not in the inner surface of the nozzle nut as in the conventional arrangement but in the check valve guide 6*d*, it is possible to reduce the diameter of the nozzle nut and, hence, the size of the unit injector as a whole.

In the conventional unit injector, the check valve is supported at its lower side by the check valve guide which is constructed as a body separate from the injector body. When the plunger is retracted, the check valve is made to contact with the lower end of the plunger barrel to close the cylinder bore of the barrel thereby to prevent the fuel from returning. For this reason, the diameter of the check valve is determined by the diameter of the cylinder bore, i.e. by the diameter of the plunger. More specifically, the check valve cannot have a diameter smaller than the diameter $d_1$ of the plunger. This makes it difficult to reduce the diameter of the check valve as a whole.

The large diameter of the check valve imposes another problem that the check valve cannot promptly respond to the retracting movement of the plunger 3 to cause a time lag in the action for closing the cylinder bore of the barrel, resulting in a reverse flow of the fuel or sucking of air through the nozzle port due to vacuum generated when the plunger is retracted.

According to the described embodiment, this problem is overcome because the check valve 9 is mounted on the check valve guide 6*d* and the check valve seat 8 is placed above the check valve 9 to form a room in which the check valve 9 is allowed to move up and down, with the barrel 5 placed on the check valve seat 8. Thus, in the described embodiment, the check valve 9 is adapted to move up and down to open and close the port 8*a* formed in the check valve seat 8 and having a diameter $d_2$ smaller than that $d_1$ of the plunger 3. Since the inside diameter $d_2$ can be reduced regardless of the diameter $d_1$ of the plunger, the diameter of the check valve can be reduced correspondingly to permit the check valve to move up and down well responding to the vertical stroking of the plunger 3.

Furthermore, in the described embodiment of the invention, the injector body 6 is divided into two sections by the check valve guide 6*d*: i.e. an upper section receiving the parts of the fuel injection pump and a lower section receiving the parts of the fuel injection valve. Particularly, the lower section has a recess constituting a nozzle spring chamber 6*f* accomodating the nozzle spring 13 and receiving the leaked fuel. This nozzle spring chamber 6*f* is communicated with the fuel well 6*a* of the injection pump through a fuel passage 6*e* thereby to permit the fuel to be returned to the low-pressure section. The lower end of the nozzle spring chamber is closed by the valve stopper spacer 27 thereby to support the end of the nozzle valve, and a fuel passage 27*a* communicating with the fuel passage 6*c* in the injector body is formed in the valve stopper spacer 27. The valve stopper spacer 27 is located in relation to the injector body by means of a knock pin 17. This arrangement permits the nozzle spring chamber to have a reduced size. By reducing the diameter of the injection valve portion which is inserted deeply into the cylinder head, it is possible to preserve a large area for the cooling water passage in the cylinder head.

Furthermore, according to the invention, the upper surface of the barrel holder 7 serves as a spring retainer for retaining the end of the plunger spring 4 adjacent to the barrel 5.

Figure 3:
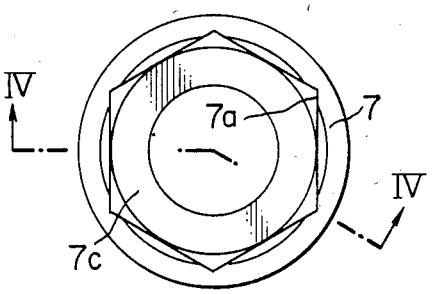
FIG. 3 is a plan view of a barrel holder.
Figure 4:
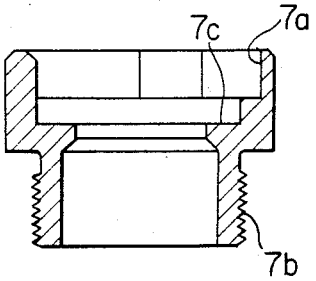
FIG. 4 is a sectional view taken along the line IV—IV of FIG. 3.
Figure 5:
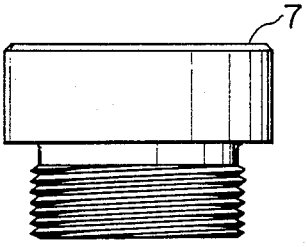
FIG. 5 is a front elevational view of the barrel holder shown in FIG. 3.

FIGS. 3, 4 and 5 show an example of the barrel holder 7 which is externally threaded so as to be screwed into the threaded bore of the injector body 6. A hexagonal bore 7*a* adapted to be engaged by a screwing tool is formed in the barrel holder 7. The bottom surface 7*c* of the hexagonal bore 7*a* serves as the surface for supporting the plunger spring 4. Since the barrel holder 7 is screwed into the injector body, it is possible to fit the tappet 1 to the upper projecting portion of the injector body thereby to permit the tappet to slide up and down. It is, therefore, possible to reduce the size of the unit injector as a whole. In addition, by making the spring retainer serve also as the barrel holder, it is possible to reduce the number of the parts.

Figure 6:
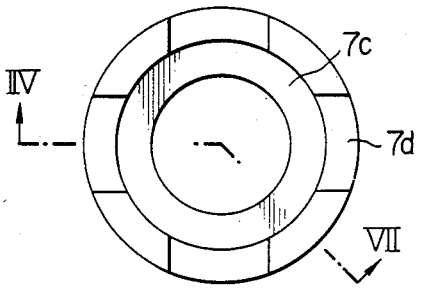
FIG. 6 is a plan view of another example of the barrel holder.
Figure 7:
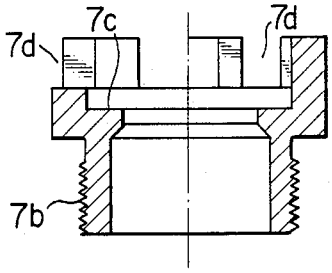
FIG. 7 is a sectional view taken along the line VII—VII of FIG. 6.
Figure 8:
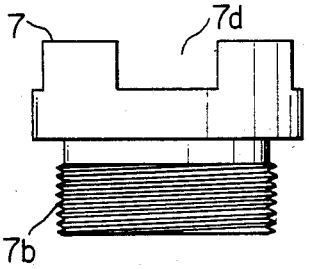
FIG. 8 is a front elevational view of the barrel holder shown in FIG. 6.

FIGS. 6, 7 and 8 in combination show a modification of the barrel holder in which, instead of the tool engaging hexagonal hole 7*a* in the barrel holder shown in FIGS. 3 to 5, grooves 7*d* are formed for engagement with the screwing tool.

In the conventional fuel injection system, the injection rate adjusting device of the injection pump is connected to a governor by means of a rack-and-pinion type connecting mechanism. More specifically, a rack connected to the link of the governor meshes with a pinion formed on the outer periphery of the plunger so that the linear motion produced by the governor is converted into the rotation of the plunger thereby to adjust the rate of injection of the fuel. The rack-and-pinion type mechanism, however, is extremely difficult to assemble particularly when it is applied to a small-sized delicate device such as unit injector and incurs a rise of the production cost. Thus, there is an increasing demand for a connecting mechanism having a simple construction easy to assemble. In the embodiment shown in FIG. 1, it is to be noted that the control lever is projected from a portion of the plunger and is directly connected to the link of the governor so that the rack-and-pinion type mechanism is omitted to permit the reduction in size of the unit injector and to reduce the requirement for precision of assembling. This type of connection mechanism offers another advantage that the non-uniformity of fuel injection rates of all unit injectors can be corrected and eliminated by adjusting the angular position of the control lever.

In the described embodiment, the tappet 1 is projected to the level above the projecting end of the plunger 3 to form the aforementioned horse-shoe-like upper portion, and the control lever 2 is disposed so as to be able to rotate within the opened portion defined by the edges 1*c*, 1*c*. The horse-shoe-like upper end portion of the tappet 1 has a recess 1*b* which receives the tappet plate 21. If the tappet plate 21 is fixed by welding to the tappet 1, it becomes difficult to assemble the control lever 2 and the plunger 3. In addition, since the tappet plate 21 is pressed at its upper side by the rocker arm, the tappet plate 1 is liable to be worn down rapidly. To avoid the rapid wear of the tappet plate 21, it is necessary to use a material different from the material of the tappet 1 as the material of the tappet plate 21. This makes it difficult to fix the tappet plate 21 by welding. Under this circumstance, in the described embodiment of the invention, the structure around the upper part of the plunger is simplified to facilitate assembling and renewal of parts.

As has been explained, in the described embodiment of the invention, the end of the plunger is projected upward from the cylindrical tappet and the tappet plate disposed on the plunger is made to rest on the tappet. Therefore, the rocker arm does not make direct contact with the upper surface of the plunger but presses the tappet plate 21, so that the undesirable wear and distorsion of the plunger is completely eliminated. Furthermore, since the tappet plate 21 is not welded to the tappet 1, the tappet plate 21 can easily be separated from the tappet to facilitate assembling and disassembling of the unit injector. The tappet plate 21 can easily be replaced with new one as a consumed part when it has been worn down to a predetermined degree.

In general, the fuel injection pump is provided at its delivery side with a delivery valve or a check valve. However, no valve which would make a checking function is installed at the suction port 5*a* of the barrel 5. Namely, at the suction side of the fuel injection pump, the closing of the suction passage is made by the plunger moving in the cylinder bore of the barrel 5 when the end of the same comes to block the suction port 5*a*. At the moment of complete blocking of the suction port, the fuel as returning fuel is injected toward the surface of the fuel well 6*a* in the injector body 6. This phenomenon is usually referred to as spill. The spilt fuel strikes the portion of the wall of the fuel well 6*a* opposing to the suction port to erode such a portion of the wall.

In order to prevent the erosion by the spill, various measures are taken to stengthen the above-mentioned portion of the wall. For instance, a spill deflector made of a different material is embedded in the portion of the wall struck by the spill, or the head of a bolt is projected to the area where the spill strikes most strongly.

However, since the well in the unit injector is formed by recessing the inner peripheral wall of the injector body, it is quite difficult to insert the rigid member into these parts and the assembling and disassembling are made difficult accordingly.

According to the described embodiment, the spill deflector 10 is made of a sheet of a spring steel to have a light and small size and is bent in an arcuate form and fitted in the fuel well 6*a*. The vertical movement of the spill deflector 10 is prevented by the upper and lower walls of the fuel well 6*a*. The spill deflector is also prevented from rotating by means of the spring pin 11.

Figure 9:
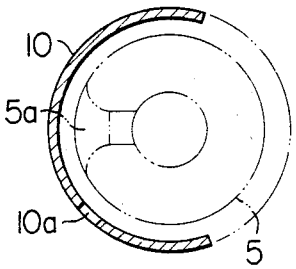
FIG. 9 is a cross-sectional view of a spill deflector.
Figure 10:
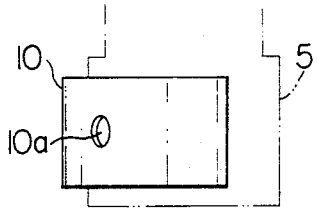
FIG. 10 is a front elevational view of the spill deflector.

The shape of the spill deflector 10 is shown in FIGS. 9 and 10. The spill deflector 10 is provided at a portion thereof with a hole 10*a* for receiving the spring pin 11. The spring pin 11 is located offset from the point opposing to the suction port 5*a*, averting any strong impact by the spill. If the spill deflector has a radius of arc smaller than the inside diameter of the barrel, the spill deflector makes close contact with the barrel while blocking the suction port 5*a*. Therefore, the spill deflector is made to have an arcuate form spreading over an angle greater than 180° and having a radius greater than the inside diameter of the fuel well. For detaching the spill deflector, the latter is slightly displaced by a finger to close the spring pin hole by the spill deflector 10. Then, a rod-like tool is inserted into the spring pin hole to force the spill deflector 10 out of the groove in the fuel well 6*a* and, then, the spill deflector 10 is picked up by the fingers.

Thus, in the described embodiment of the invention, the spill deflector is made of an arcuate resilient plate which makes a close fit to the wall of the fuel well 6*a* due to its resiliency. In addition, the resilient spill deflector made from a spring steel exhibits a high resistance to erosion caused by the spill of the fuel.

Figure 11:
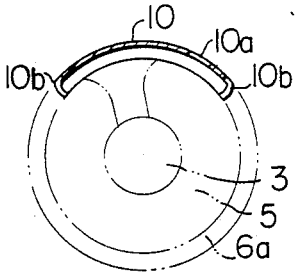
FIG. 11 is a cross-sectional view of another example of the spill deflector.
Figure 12:
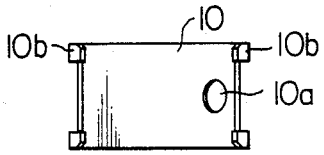
FIG. 12 is a front elevational view of the spill deflector.
Figure 13:
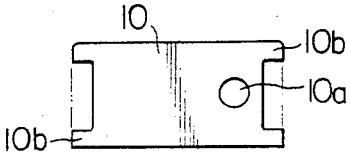
FIG. 13 is a developed view of the spill deflector.

FIGS. 11, 12 and 13 show another example of the spill deflector. A hole 10*a* for receiving a spring pin 11 is formed at the right side of the center of the spill deflector 10 as viewed in FIG. 12. The spill deflector 10 as a whole has an arcuate form as shown in FIG. 11 and, as will be understood from the exploded view in FIG. 13, bent tabs 10*b* are formed at four corners of the spill deflector 10. These tabs are bent as shown in FIGS. 11 and 12. On the other hand, an annular groove constituting the fuel well 6*a* formed in the inner peripheral surface of the injector body 6 has a dovetail-shaped cross-section. The spill deflector 10 is closely fitted to the bottom surface of the annular groove opposing to the suction port 5*a*. In this state, the four bent tabs 4 of the spill deflector 10 are made to engage the tapered surfaces of the annular groove thereby to fix the spill deflector against vertical movement. The rotational movement of the spill deflector is prevented by the spring pin 11 which fits in the hole 10*a*. As in the case of the example explained in connection with FIGS. 9 and 10, the spill deflector is formed by the spring steel which has a substantial resistance to erosion. In this case, however, a further reduction of size is possible thanks to the specific construction explained hereinabove. The provision of the bent tabs 10*b* also facilitates the handling of the spill deflector during assembling and disassembling.

In the case where the diesel engine has a plurality of cylinders, the unit injector together with associated actuating parts such as rocker arm is provided for each cylinder. The control levers of all unit injectors are rotated by the link of a common governor, thereby to effect the speed control of the engine. If there is a variation or difference of fuel injection rate among these unit injectors, the fuel consumption is increased uneconomically and the output power of the engine is lowered undesirably. In order to attain a uniformity of fuel injection rate, according to the described embodiment, the unit injectors are so constructed and assembled that they can have a constant and equal fuel injection rate when the control lever is rotated fully to make contact with the edge 1*c* of the tappet in each unit injector.

More specifically, the unit injectors are adjusted to provide an equal fuel injection rate at the point of start of the rotation of control lever, and the control levers of all unit injectors are connected to the link of the common governor in this state, so that the all unit injectors inject the fuel at an equal rate. The adjustment of each unit injector is made by rotating the tappet 1 having the reference edge 1*c* relatively to the injector body by means of a rotary plate 25*a* and an eccentric pin 25.

Figure 14:
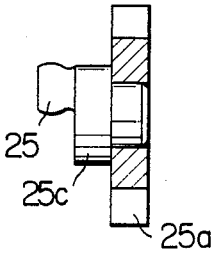
FIG. 14 is a front elevational view of an eccentric pin and a rotary plate.
Figure 15:
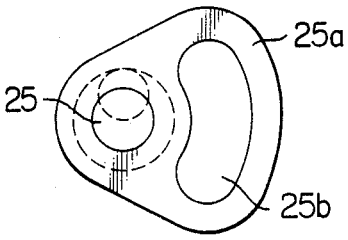
FIG. 15 is a rear elevational view of the eccentric and the rotary plate.

As will be seen from FIGS. 14 and 15, the eccentric pin 25 and the rotary plate 25*a* are fixed to each other by welding. The rotary plate 25*a* is provided with an elongated hole 25*b* into which a bolt 26 is passed which is to be tightened to the injector body after the adjustment.

Referring back to FIG. 1, the eccentric pin 25 is received by a vertical groove 1*d* formed in the tappet 1. The eccentric pin 25 has an enlarged portion, 25*c* which is rotatably received by a circular hole formed in the injector body 6. Therefore, as the rotary plate 25*a* is rotated after loosening the bolt 26, the tappet 1 rotates within the injector body 6 through the action of the eccentric pin 25.

As a result of rotation of the tappet 1, the reference edge 1*c* on the tappet 1 is rotated to the left and right to vary the range of rotation or swinging of the control lever 2. Using this adjusting mechanism, it is possible to beforehand adjust the unit injectors such that they provide an equal fuel injection rate when the control lever 2 contacts the reference edge 1*c* in each unit injector and, hence, to obtain uniformity of fuel injection rate over all cylinders.

In the case where a unit injector is used as the injection device, it is not possible to mount the cam shaft and cam above the cylinder head because the fuel injection pump of the unit injector is mounted on the cylinder head. It is, therefore, necessary to arrange such that the tappet of the plunger is depressed by a rocker arm which made to rock by a push rod operated by a cam, as in the case of the intake and exhaust valves. This arrangement inconveniently increases the chance of error of the injection timing. It is, therefore, necessary to indicate the position of the plunger in each unit injector, and to adjust the effective lengths of the rocker arm and the push rod in accordance with the indicated position, i.e. timing.

Figure 16:
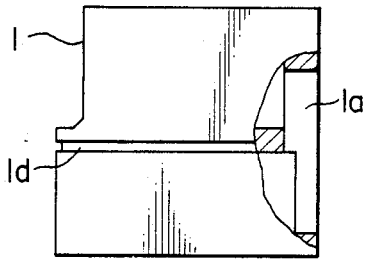
FIG. 16 is a front elevational view of a tappet with a part thereof being broken away.

In the described embodiment, the indication of position of the plunger, i.e. the injection timing, is indicated by the following arrangement. As shown in FIGS. 1 and 16 the tappet 1 is provided at its outer peripheral surface with a locating groove 1*d*. A reference line 6*h* is scribed in the injector body 6 in alignment with the groove 1*d* in the outer peripheral surface of the tappet 1 when the top surface 3*c* of the plunger 3 is brought into alignment with the edge 5*b* of the suction port 5*a* adjacent to the top dead center. For adjusting the injection timing in each unit injector, the push rod and the rocker arm are adjusted with the groove 1*d* positioned in alignment with the reference line 6*h*. By adjusting each unit injector in a manner explained above, it is possible to obtain a constant injection timing for all unit injectors and, accordingly, to achieve fuel injection and combustion of all cylinders in good order.

This eliminates the irregular firing and hunting of the engine thereby to achieve a fuel economy and higher output of the engine.

In contrast to the conventional unit injector in which the link of the governor device is connected to the tappet to rotate the plunger through the medium of the tappet, in the described embodiment, the control lever 2 is is connected to the top of the plunger 2 through a pin 28 so that the plunger 3 is rotated directly by the governor. Therefore, the control lever 2 is required to move up and down accompanying the plunger 3, while being rotated or swung for the adjustment of the fuel injection rate. In order that the control lever 2 makes these motion at a high frequency, it is essential that the weight of the control lever is decreased. To this end, the control lever is recessed substantially in a U-like form and the operative connection between the control lever and the governor link is smoothed.

By so doing, it is possible to construct such that the tappet 1 can be rotated by means of the eccentric pin 25 for adjusting the fuel injection rate of each unit injector, to permit various advantages explained before.

Furthermore, the construction of the control lever is simplified to contribute to the reduction of size of the unit injector as a whole.

Figure 19:
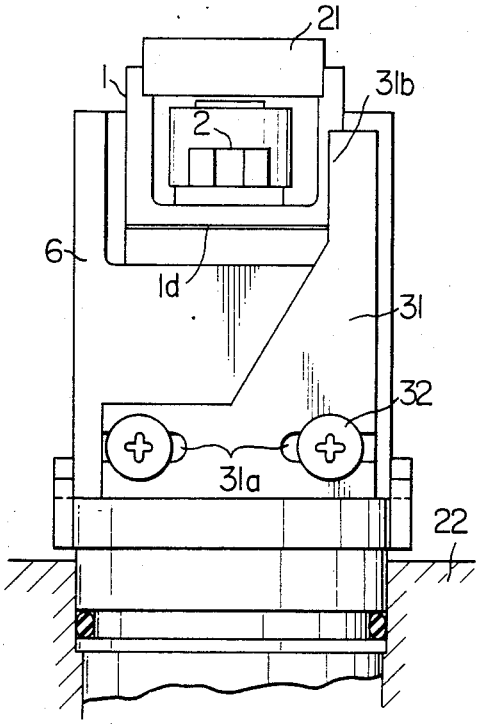
FIG. 19 is a left side elevational view of the second embodiment.
Figure 18:
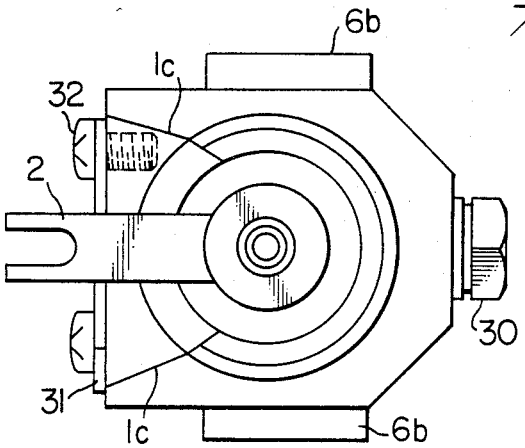
FIG. 18 is a plan view of the second embodiment.
Figure 17:
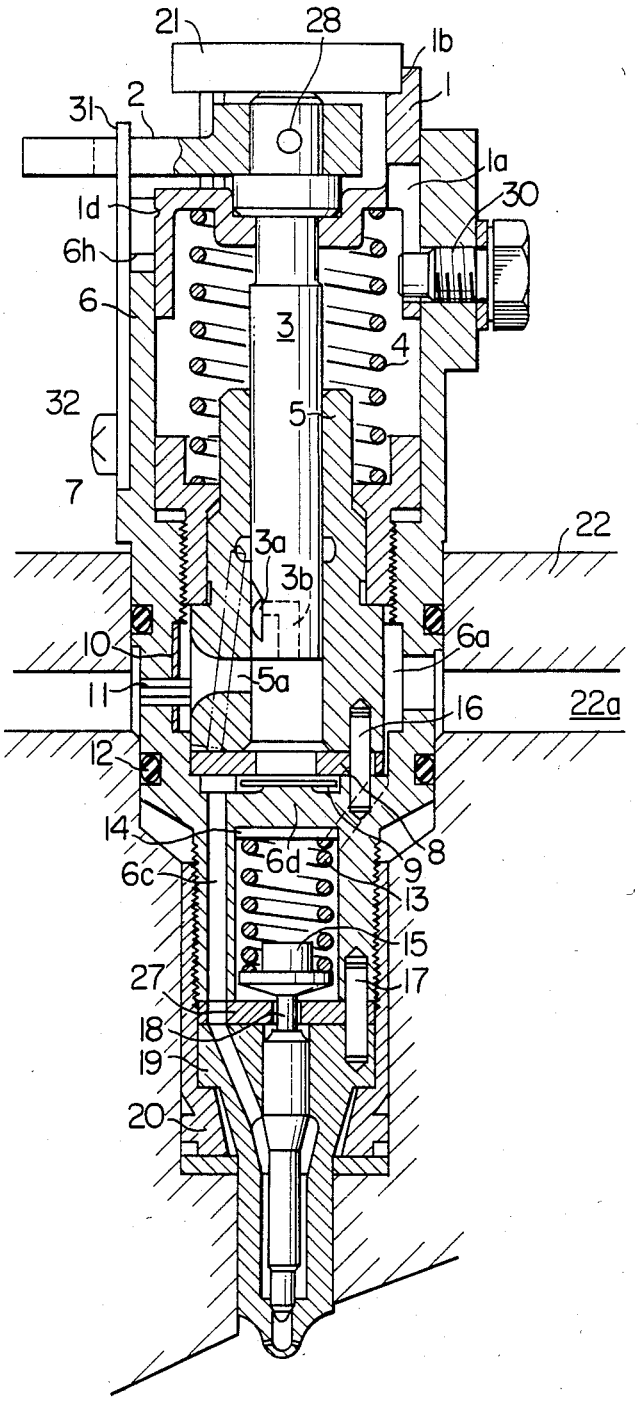
FIG. 17 is a vertical sectional view of a second embodiment.

FIGS. 17, 18 and 19 show a second embodiment of the invention in which, instead of the adjusting device of the first embodiment explained in connection with FIGS. 14 and 15, means are provided for limiting the width of movement of the control lever. Other portions are materially identical to those of the first embodiment and, therefore, are not described here in detail.

As will be seen from FIG. 17, an engaging bolt 30 has an end engaged with a vertical groove 1*a* formed in the tappet 1, thereby to limit the range of vertical movement of the tappet 1. A limiting device 31 is fastened to the outer peripheral surface of the injector body 6 by means of screws 32 extended through elongated holes 31*a*, 31*a* formed therein. The limiting device 31 has a limiting surface 31*b* contacted by the side surface of the control lever 2 to prevent further rotation of the control lever 2.

In order to prevent the variation of the rotational positions of the plungers attributable to the fluctuation of rotation angles of the control levers of all unit injectors. A reference limit position such as a position corresponding to zero fuel injection, minimum fuel injection rate or maximum fuel injection rate is confirmed when the injectors are assembled in the factory. After loosening the screws 32, the limiting device 31 is placed at such a reference limit position and then the screws are tightened to fix the limiting device 31 to the injector body 6 at this posiiton. Then, the control levers of all unit injectors are connected to a common governor in the state contacting respective limiting devices. It is thus possible to make uniform the fuel injection rate of all cylinders. According to this invention, it is possible to make uniform the fuel injection rate of all unit injectors at the time of production in the factory and, hence, to obviate trouble such as irregular rotation or reduction of power.

Figure 20:
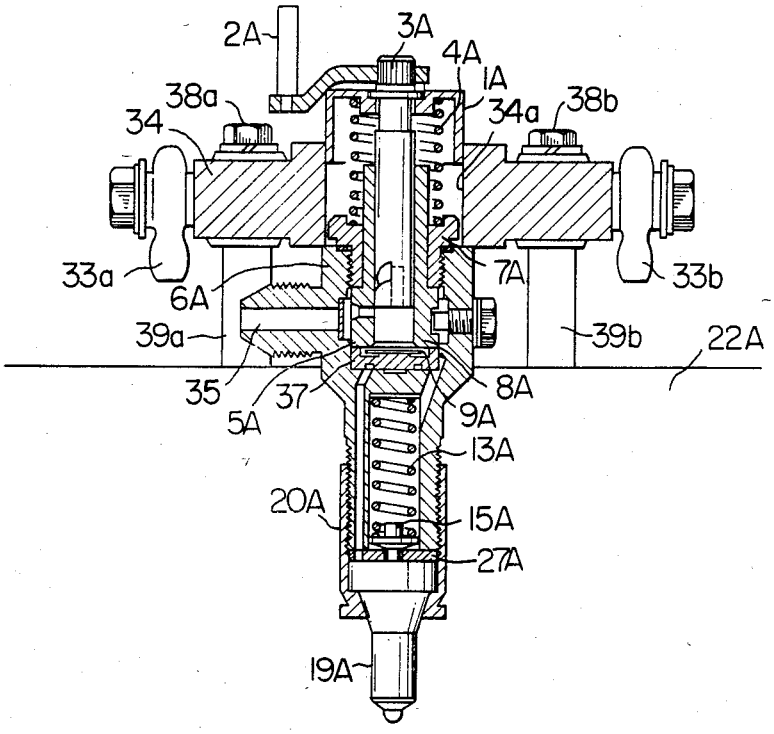
FIG. 20 is a vertical sectional view of a third embodiment of the invention.
Figure 21:
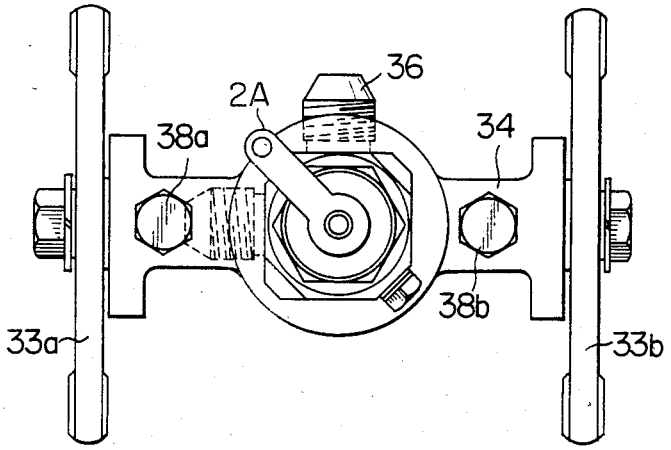
FIG. 21 is a plan view of the third embodiment.

FIGS. 20 and 21 show a third embodiment of the invention in which the unit injector is fixed to the cylinder head by making use of a part of the valve arm supporting base mounted on the cylinder head.

The unit injector has been proposed as an improvement in the conventional fuel injection system in which the fuel injection pump is installed on the side surface of the cylinder block separately from the injection valve mounted on the cylinder head. The size of the unit injector, therefore, is somewhat greater than the fuel injection valve of the conventional injection system. In addition, it is necessary to mount rocker arm and other associated members for pressing the tappet. The space on the cylinder head is inherently limited and is further restricted by the mounting of other parts such as intake and exhaust valves as well as valve actuating mechanisms. It is very difficult to find the room for mounting the unit injector while avoiding interference with other parts. In order to mount these parts in the limited space on the cylinder head, in the embodiment shown in FIGS. 20 and 21, the supporting base 34 for the valve arms 33*a* and 33*b* is overlapped to the position where the unit injector is mounted. Namely, the valve arm supporting base 34 is provided with a central opening which serves as a slide guide for the tappet 1A.

More specifically, the unit injector of this embodiment has an injector body 6A integrally provided with a fuel inlet port 35 and a fuel return port 36. A nozzle spring 13A, nozzle spring seat 15A are inserted into the injector body 6 from the lower side and a valve stop spacer 27A is fitted to the lower side of the nozzle spring seat 15A to cover the latter from the lower side.

A nozzle body 19A receiving a nozzle valve is fitted to underlie the valve stop spacer and is fastened to the injector body 6A by means of a nozzle nut 20A. From the upper side of the injector body 6A, inserted are a check valve seat 37, check valve 9A, plunger barrel 5A and a plunger 3A. These parts are fastened by means of a barrel holder 7A screwed into the injector body. The valve arm supporting base 34 is mounted on the upper end of the injector body 6A, and the bolts 38*a*, 38*b* for fixing the valve arm supporting base are screwed into the projections 39*a*, 39*b* formed on the cylinder head 22A thereby to fix the unit injector. Then, a tappet 1A is inserted into an opening 34*a* formed in the valve arm supporting base 34. Thus, in this embodiment of the invention, the wall defining the central opening 34*a* serves as a guide for guiding the vertical movement of the tappet. A reference numeral 4A designates a spring for upwardly biasing the plunger 3A, while a reference numeral 2A denotes a control lever.

A rocker arm (not shown) depresses the top of the tappet 1A or the top of the plunger 3A to pressurize and deliver the fuel. The control of the fuel injection rate is made by rotating the plunger 3A by means of the control lever 2A.

The valve arm suporting base 34 is intended for supporting the valve arms 33*a*, 33*b* of the intake and exhaust valves, and is usually mounted averting from the position where the unit injector is mounted. In this embodiment, however, it is possible to overlap the unit injector and the valve arm supporting base by arranging such that the tappet is guided by the wall of the oening formed in the valve supporting base. It is also possible to make the valve arm base 34 support the rocker arm (not shown) for the unit injector.

Conventionally, the supporting base for the rocker arm of the unit injector is mounted on the cylinder head separately from the valve arm supporting base so that the space on the cylinder head is very crowded with a large number of parts. However, in the third embodiment of the invention described heretofore, the arrangement of parts on the cylinder head is simplified thanks to the fact that the valve arm supporting base serves also as a support and guide for the unit injector. Namely, according to this embodiment of the invention, the unit injector is fixed to the cylinder head by making use of a part of the valve arm supporting base 34 on the cylinder head 22A. Thanks to the common use of the supporting base as a member for supporting the valve arms and as the member for supporting and guiding the unit injector, it is possible to reduce the number of parts and to simplify the arrangement of parts on the cylinder head, by arranging the unit injector and the valve arm supporting base in an overlapping manner.

What is claimed is:

1. A fuel injector for internal combustion engines comprising a plunger adapted to be reciprocated for pressurizing a supplied fuel, a barrel for receiving said plunger with clearance fit for sliding movement of the latter, a nozzle valve adapted to inject the pressurized fuel into the engine, a check valve interposed between said plunger and said nozzle valve, and an injector body adapted to house said plunger, barrel, nozzle valve and check valve within one body, said injector body being formed substantially in a cylindrical shape having an upper bore and a lower bore which are separated by a partition and which are opened on the upper side and the lower side of said body, respectively, said upper bore being adapted to define a chamber for receiving a plunger spring and a bore portion for receiving said barrel with said plunger and said lower bore being adapted to define a nozzle spring chamber so that when assembled into the unit, a nozzle spring, a nozzle body and said nozzle valve are inserted into said lower bore from the lower side of said injector body and secured in place by means of a nozzle nut screwed to said injector body from the lower side thereof while said check valve, barrel with said plunger, and plunger spring are inserted into said upper bore from the upper side of said injector body and secured in place by means of a barrel holder screwed into an internally threaded portion formed in said upper bore.

2. A fuel injector as claimed in claim 1, where said injector body has a fuel well so formed in the inner peripheral surface of said bore portion for receiving said barrel as to communicate with a fuel suction port formed in said barrel and said fuel well and said nozzle spring chamber are separated from each other by said partition wall supporting said check valve but communicate with each other through a fuel passage formed through said partition wall.

3. A unit fuel injector as claimed in claim 1, wherein the upper surface of said barrel holder for securing said barrel to said injector body serves as a retaining surface for retaining the lower end of said plunger spring, said plunger spring extending coaxially with said barrel.

4. A fuel injector as claimed in claim 1, wherein said barrel is fitted in said upper bore of said injector body and fastened and fixed at its outer side by said barrel holder screwed into said upper bore, and said barrel holder is provided on the upper portion thereof with a groove for engagement by a tool for screwing said barrel holder which groove serves also as retainer for retaining the lower end of said plunger spring.

5. A fuel injector as claimed in claim 1, wherein said check valve seat is adapted to be inserted into said upper bore from the upper side of said injector body and to be supported on a bottom portion of said upper bore in such a manner as to abut against the end of said barrel when the latter is positioned in said upper bore, said nozzle spring chamber is formed in a portion of said injector body under a partition wall so that said upper bore portion for receiving the barrel and said nozzle spring chamber are separated from each other by said partition wall serving also as a check valve guide, and said nozzle spring chamber is closed at its lower end by a valve stop spacer.

6. A fuel injector as claimed in claim 1, wherein a cylindrical tappet is reciprocably fitted in said injector body with an upper peripheral portion of said tappet adapted to be accessible from the upper side of said injector body, and said tappet has a portion formed for retaining the upper end of said plunger spring and a guide recess formed in the upper end of said tappet, in which a tappet plate is fitted so as to be removably connected with said plunger.

7. A fuel injector as claimed in claim 1, wherein said injector body has a fuel well formed between the inner peripheral surface of said upper bore portion for receiving said barrel and the outer peripheral surface of said barrel to provide a gap for permitting a fuel suction port of said barrel to communicate with a passage for supplying fuel to the injector, an arcuate spill deflector is disposed in the gap portion of the inner peripheral surface of said upper bore portion for receiving said barrel so that said spill deflector confronts said suction port of the barrel, and said spill deflector is located by a pin which is provided through said injector body and is adapted to fit in an aperture formed in said spill deflector.

8. A fuel injector as claimed in claim 1, wherein a cylindrical tappet is reciprocably fitted in said upper bore, said tappet has a portion formed for retaining the upper end of said plunger spring and locating means so provided on the outer peripheral surface of said tappet as to come into alignment with a reference line scribed in said injector body when a fuel suction port formed in said barrel is closed by said plunger during the reciprocation of the latter.

9. A fuel injector as claimed in claim 1, wherein a cylindrical tappet is reciprocably fitted in said injector body with an upper portion of said tappet adapted to be accessible from the upper side of said injector body, said tappet has a portion formed for retaining the upper end of said plunger spring, said plunger has an end projecting through said cylindrical tappet, a control lever is disposed above said tappet to be connected at one end thereof to said projecting end of the plunger, and said cylindrical tappet is formed in its upper peripheral portion with an opening defined by cut edges for limiting the maximum range of rotation of said control lever.

10. A fuel injector as claimed in claim 9, wherein said tappet is formed with a vertical groove in the outer peripheral surface thereof at a position corresponding to a hole formed through said injector body, said vertical groove receives a pin which is eccentric relatively to said through hole of the injector body and has a portion rotatably received by said through hole, the rotatable portion of said eccentric pin is adapted to be fixed to said injector body after adjustment of the position of said eccentric pin for preventing said pin from rotating relatively to said injector body, and the other end of said control lever is bifurcated to have U-shaped opening for receiving a link of a governor, the inner surface of which extends in the same direction as that of said vertical groove of the tappet so that said control lever is slidable relatively to said link of the governor in accordance with the reciprocation of said plunger.

11. A fuel injector as claimed in claim 9, wherein said tappet is formed with a vertical groove in the outer peripheral surface thereof a position corresponding to a hole formed through said injector body, said vertical grooves receives a pin which is eccentric relatively to said through hole of the injector body and has a rotary plate portion fitted in said through hole, the rotary plate portion of said eccentric pin is adjustable in its rotational position relative to said injector body to change the limited range of rotation of said control lever by rotating said tappet so that it is possible to equalize the fuel injection rates of all fuel injectors mounted on different cylinders of the engine.

12. A fuel injector as claimed in claim 1, wherein said check valve is disposed to face the end face of said plunger, a check valve seat is adapted to be mounted on a bottom portion of said upper bore for receiving said barrel and be secured in place through said barrel by means of said barrel holder so as to be interposed between said bottom portion of said upper bore and the corresponding end face of said barrel, and said injector body having a passage formed therein to introduce fuel from said check valve to said nozzle valve.

13. A fuel injector for internal combustion engines, comprising:

a unitary cylindrical housing having a stepped inner bore, and a partition wall dividing said stepped inner bore into a larger diameter bore on one axial side thereof and a smaller diameter bore on the other axial side thereof;

said housing having internally threaded portion in the region of said larger diameter bore and an externally threaded portion in the region of said smaller diameter bore;

a plunger adapted to be reciprocably mounted in said larger bore for pressurizing a supplied fuel, a barrel for receiving said plunger with clearance fit for sliding movement of the latter, and a check valve, said plunger, said barrel and said check valve being adapted to be inserted into said larger bore and to be held in position therein by a barrel holder means screwed into said internally portion; and nozzle valve means for injecting pressurized fuel into the engine, said nozzle valve means adapted to be inserted into said smaller diameter bore, and nozzle nut means adapted to be screwed on to said externally threaded portion of said housing for retaining said nozzle valve means in said smaller diameter bore.

* * * * *

UNITED STATES PATENT AND TRADEMARK OFFICE

CERTIFICATE OF CORRECTION

PATENT NO. : 4,565,320

DATED : January 21, 1986

INVENTOR(S) : Hiroyuki Taniguchi et al.

It is certified that error appears in the above-identified patent and that said Letters Patent is hereby corrected as shown below:

Claim 10, line 65, after "to have" insert --a--;

Claim 11, line 7, "grooves" should read --groove--;

Claim 13, line 8, after "having" insert --an--";

Claim 13, line 19, after "internally" insert --threaded--.

Signed and Sealed this

*Fifteenth* Day of *April 1986*

[SEAL]

*Attest:*

DONALD J. QUIGG

*Attesting Officer*

*Commissioner of Patents and Trademarks*